United States Patent [19]

Miyamoto et al.

[11] Patent Number: 4,487,441

[45] Date of Patent: Dec. 11, 1984

[54] CHILD PROOF DOOR LOCKING DEVICE

[75] Inventors: Issei Miyamoto, Yokohama; Shunji Utsumi, Yokosuka; Takayo Chikaraishi, Kawasaki, all of Japan

[73] Assignees: Nissan Motor Company, Limited; Ohi Seisakusho Co., Ltd., both of Yokohama, Japan

[21] Appl. No.: 413,529

[22] Filed: Aug. 31, 1982

[30] Foreign Application Priority Data

Sep. 29, 1981 [JP] Japan ..... 56-153064

[51] Int. Cl.[3] ..... E05B 3/00

[52] U.S. Cl. ..... 292/336.3; 292/216; 292/DIG. 27; 292/DIG. 65

[58] Field of Search ..... 292/216, 280, DIG. 65, 292/DIG. 27, 336.3

[56] References Cited

U.S. PATENT DOCUMENTS

| | | | |
|---|---|---|---|
| 2,625,420 | 1/1953 | Endter | 292/DIG. 27 |
| 2,658,781 | 11/1953 | Allen | 292/DIG. 27 |
| 2,782,062 | 2/1957 | Smith | 292/DIG. 27 |
| 3,049,372 | 8/1962 | Pickles | 292/280 X |
| 3,065,013 | 11/1962 | Pickles | 292/DIG. 65 |
| 3,111,339 | 11/1963 | Nadeau | 292/DIG. 65 |
| 3,923,329 | 12/1975 | Torii et al. | 292/DIG. 27 X |
| 4,334,704 | 6/1982 | Yamada | 292/216 |

FOREIGN PATENT DOCUMENTS

| | | |
|---|---|---|
| 7009223 | 2/1970 | Fed. Rep. of Germany . |
| 819911 | 9/1959 | United Kingdom . |
| 1108435 | 4/1968 | United Kingdom . |
| 1165142 | 9/1969 | United Kingdom . |
| 1229596 | 4/1971 | United Kingdom . |
| 1278699 | 6/1972 | United Kingdom . |

*Primary Examiner*—Gary L. Smith
*Assistant Examiner*—Thomas J. Dubnicka
*Attorney, Agent, or Firm*—Lane, Aitken and Kananen

[57] ABSTRACT

A child proof door locking device for use with an automotive door is disclosed, which comprises a base plate securely attached to the door, an inside lever pivotally connected to the base plate and pivotally movable in response to handling of the inside handle, an outside lever pivotally connected to the base plate and pivotally movable in response to handling of the outside handle, a first device for causing the latching device to assume its inoperative condition when the outside lever is pivoted in a given direction, a second device for linking the outside lever with the inside lever so that pivoting of the inside lever in a given direction induces the pivoting of the outside lever in the given direction, and a child proof lever pivotally connected to the base plate and disengaging the second device from the inside lever when assuming its child proof position.

8 Claims, 5 Drawing Figures

CHILD PROOF DOOR LOCKING DEVICE

BACKGROUND OF THE INVENTION

1. Field of the Invention

The present invention relates in general to a door locking device, and more particularly to a child proof door locking device for use with an automotive sliding door.

2. Description of the Prior Art

A child proof door locking device has been proposed for safety of the children in a motor vehicle. The locking device is so designed that once the door is locked by handling a child proof mechanism of the device, the locking is not cancelled even when a door-mounted inside handle linked to the locking device is handled by the passengers or the children in the vehicle. Usually, such locking device comprises a so-called "child proof lever" which is mounted in an unnoticeable portion of the door. When assuming its operative position, the lever comes into direct engagement with an inside lever linked to the inside handle to disable a movement of the inside lever. However, in this type locking device, there is a high possibility of damaging the contacting portions of the child proof lever and the inside lever when the inside handle is strongly and roughly handled under such child proof locking condition.

SUMMARY OF THE INVENTION

According to the present invention, there is provided a child proof door locking device for use with an automotive door having an inside handle, an outside handle, and a locking knob which are cooperated with one another to operate a latching device mounted to the door. The child proof door locking device comprises a base plate securely attached to the door, an inside lever pivotally connected to the base plate and pivotally movable in response to handling of the inside handle, an outside lever pivotally connected to the base plate and pivotally movable in response to handling of the outside handle, a first device for causing the latching device to assume its inoperative condition when the outside lever is pivoted in a given direction, a second device for linking the outside lever with the inside lever so that pivoting of the inside lever in a given direction induces the pivoting of the outside lever in the given direction, and a child proof lever pivotally connected to the base plate and disabling the second device when assuming its child proof position.

BRIEF DESCRIPTION OF THE DRAWINGS

Objects and advantages of the present invention will become clear from the following description when taken in conjunction with the accompanying drawings, in which.

DESCRIPTION OF THE INVENTION

Figure 1:
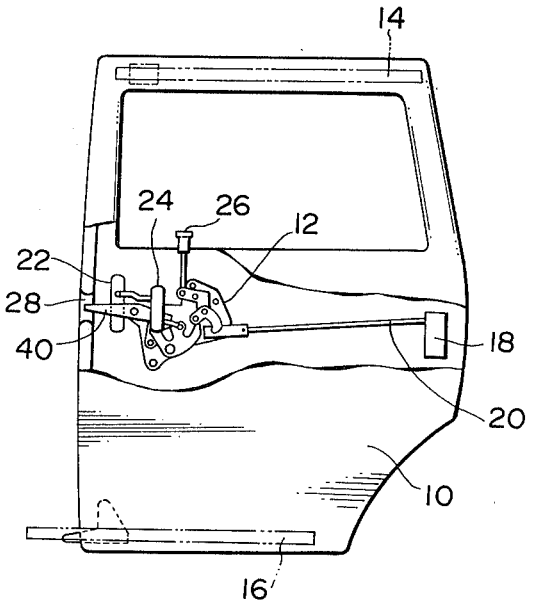
FIG. 1 is a partially broken front view of an automotive sliding door to which a child proof door locking device according to the present invention is practically applied.

Referring to FIG. 1, there is shown an automotive sliding door 10 to which a child proof door locking device 12 according to the present invention is practically applied. The door 10 is supported or guided by upper and lower guide rails 14 and 16 secured to a side body of the vehicle (not shown), so that the door 10 is slidable in the fore-and-aft direction along the upper and lower guide rails 14 and 16 to close and open a door opening (not shown) formed in the vehicle side body. As shown, the device 12 is arranged in a vertically middle portion of the door 10, that is, in a space defined between the outer and inner panels (no numerals) of the door 10. Designated by numeral 18 is a latching device which is connected through a rod 20 to the child proof door locking device 12. An inside handle 22, an outside handle 24 and a locking knob 26 are connected to the device 12 through respective links for selectively controlling the operation of the latching device 18, as will be described hereinafter. The front end of the door 10 is formed at a portion near the device 12 with a recess 28 into which a leading end of an after-mentioned child proof lever 40 is projected. The position where the recess 28, is located is such as to be totally inaccessible when the door 10 is closed.

In the following, the child proof door locking device 12 according to the present invention will be described in detail with reference to FIGS. 2 to 5.

The device 12 comprises a base plate 30 which is securely attached to the panel of the door 10. A lever 32 is pivotally connected through a pivot pin 34 to an upper section of the base plate 30. Disposed between the right end of the lever 32 and the base plate 30 is a two-position snap action spring 36. The left end of the lever 32 is pivotally connected to a rod 38 which leads to the locking knob 26. Thus, when the locking knob 26 is pushed down for effecting door locking, the lever 32 pivots about the pin 34 in the counterclockwise direction in FIG. 2 to assume another rest position by the snap action function of the spring 36.

The child proof lever 40 is pivotally connected through a pivot pin 42 to a left upper section of the base plate 30. As is described hereinabove, the leading end **40*a* of the left arm section of the child proof lever 40 is projected into the recess 28 of the door 10. As will become clear as the description proceeds, when the left arm section of the child proof lever 40 is pushed down from the illustration position in FIG. 2, the child proof function is achieved. The leading end 40*b* of the right arm section of the child proof lever 40 is formed with an elongated slot 44 which extends along the axis of the lever 40. A two-position snap action spring 46 is disposed between the right arm section of the lever 40 and the base plate 30 so that the pivotal movement of the lever 40 is effected in a snap action manner. For allowing the lever 40 to assume two distinct positions, two spaced stoppers 48 and 50 are formed on the base plate 30 at positions selectively contactable with the leading end of the right arm section of the child proof lever 40. In the disclosed embodiment, the stoppers 48 and 50 are provided by raising up the corresponding portions of the base plate 30. Thus, it will be appreciated that the child proof function is effected when the leading end 40*b* of the lever right arm section is in contact with the upper stopper 48**.

A forked inside lever 52 having first and second arm sections **52*a* and 52*b* is pivotally connected, at the united portion thereof, through a pivot pin 54 to a lower section of the base plate 30. As will be understood from the drawings, the inside lever 52 is positioned over the child proof lever 40 with respect to the base plate 30. The leading end of the first arm section 52***a* is pivotally connected to a rod 56 which leads to the afore-mentioned inside handle 22 (see FIG. 1). It is thus to be noted that the inside lever 52 is pivoted in the counterclockwise direction when the inside handle 22 is handled.

A generally E-shaped outside lever 58 having first, second and third arm sections 58*a*, 58*b* and 58*c* is pivotally connected, at the united portion thereof, through a pivot pin 60 to the base plate 30 near the inside lever 52. As will be understood from the drawings, the outside lever 58 is positioned over the inside lever 52 with respect to the base plate 30. The leading end of the first arm section 58*a* has a bent section 58*d* which is engageable with a portion (not shown) of the aforementioned outside handle 24. Upon handling of the outside handle 24, the outside lever 58 is pivoted about the pin 60 in the counterclockwise direction in FIG. 2. An angularly U-shaped link 62 is pivotally connected at its one leg portion to the leading end of the second arm section 58*b* of the outside lever 58. The other leg portion 62*a* of the link 62 is slidably engaged with the afore-mentioned elongated slot 44 of the child proof lever 40. It is now to be noted that when the child proof lever 40 assumes its inoperative position, the U-shaped link 62 encloses the second arm section 52*b* of the inside lever 52 and contacts at the leg portion 62*a* with the left side of the second arm section 52*b*. Thus, under this condition, the counterclockwise movement of the inside lever 52 about the pin 54 brings about the movement of the E-shaped outside lever 58 about the pin 60 in the same direction. The third arm section 58*c* of the outside lever 58 is formed at its leading end with a diagonally extending elongated slot 64. A coil spring 66 is disposed about the pin 60 with its ends respectively engaged with a raised portion 68 of the base plate 30 and the first arm section 58*a* of the outside lever 58, so that the outside lever 58 is biased to rotate in the clockwise direction. Another raised portion 70 of the base plate 30 acts as a stopper for stopping the excess clockwise movement of the E-shaped outside lever 58.

The base plate 30 is formed at its right section with a curved elongated slot 72 with which a pin 74 secured to a rectangular plate 76 is slidably and reciprocatively movably engaged. The right end of the rectangular plate 76 is pivotally connected to one end of the rod 20 which leads to the afore-mentioned latching device 18 (see FIG. 1). The rod 20 is constantly biased in the rightward direction in FIG. 2.

A generally V-shaped lever 78 having first and second arm sections 78*a* and 78*b* is pivotally connected at its united portion to the right end portion of the aforementioned lever 32 through a pivot pin 80. The first arm section 78*a* of the V-shaped lever 78 has an engaging portion which is engageable with a bent end 76*a* of the above-mentioned rectangular plate 76. It is to be noted that when the locking knob 26 is kept raised assuming its door unlocking condition, the first arm section 78*a* of the lever 78 is kept engaged with the bent end 76*a* of the plate 76, as will become clear as the description proceeds. The second arm section 78*b* of the V-shaped lever 78 is provided with a pin 82 which passes through the elongate slot 64 of the third arm section 58*c* of the afore-mentioned outside lever 58. Further, the leading end of the pin 82 passes slidably through an angularly U-shaped guide slot 84 formed in the base plate 30. The guide slot 84 consists of first and second curved slot sections 84*a* and 84*b* and a straight slot section 84*c* of which both ends are merged with the first and second slot sections 84*a* and 84*b*. The first curved slot section 84*a* is formed to be concentric with the pivot pin 80 when the pin 80 assumes its lowermost position, that is, when the locking knob 26 is kept raised assuming its door unlocking position. While, the second curved slot section 84*b* is formed to be concentric with the pivot pin 80 when the pin 80 assumes its uppermost position, that is, when the locking knob 26 is pushed to assume its door locking position. It is thus to be noted that the pin 82 of the V-shaped lever 78 engages with the first curved slot section 84*a* when the pivot pin 80 assumes its lowermost position, while, the pin 82 engages with the second curved slot section 84*b* when the pivot pin 80 assumes its uppermost position.

Figure 2:
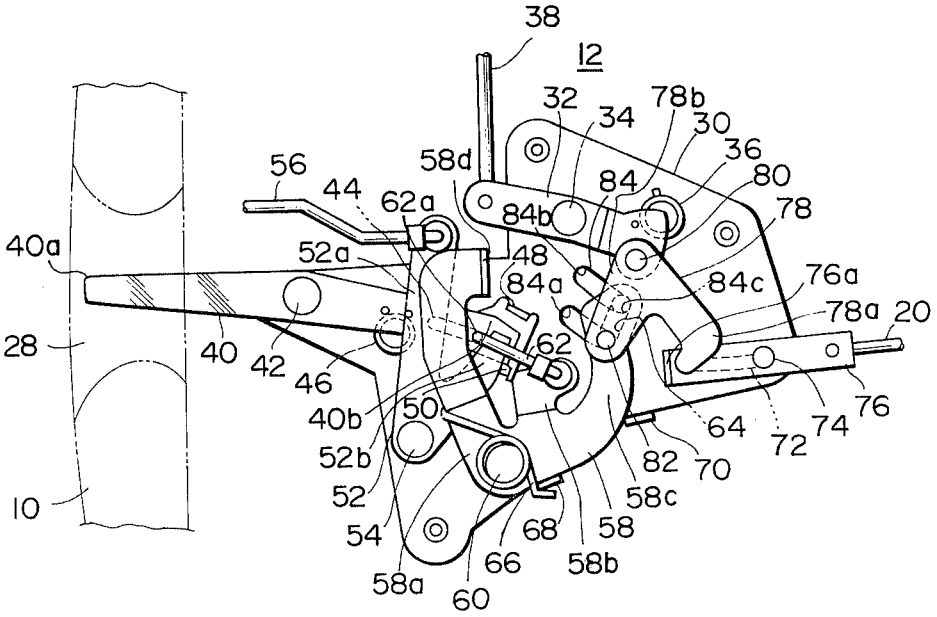
FIG. 2 is a detailed front view of the child proof door locking device of the present invention.
Figure 3:
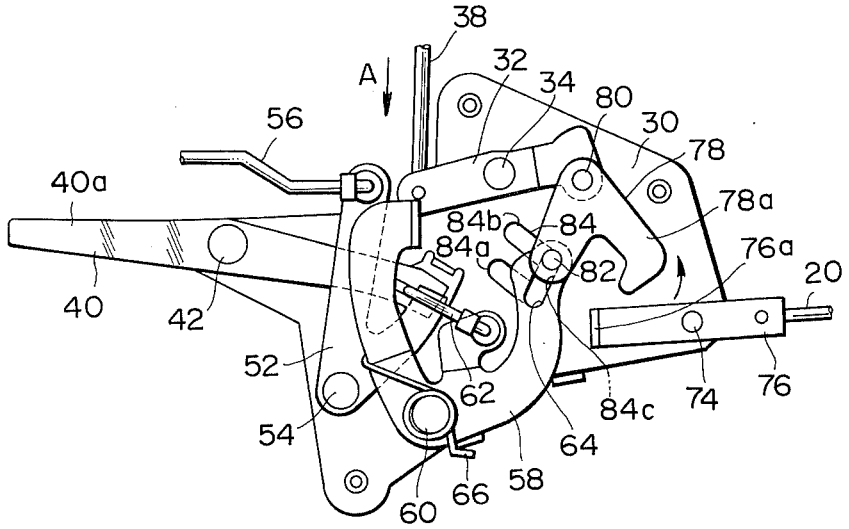
FIGS. 3, 4 and 5 are views similar to FIG. 2, but showing different operating conditions of the device, respectively.

In the following, operation will be described with reference to FIGS. 2 to 5. For facilitation, the description will be commenced with respect to a door locking condition wherein, as is shown by FIG. 3, the locking knob 26 (see FIG. 1) is pushed down to cause the pivot pin 80 to assume its uppermost position thereby disengaging the first arm section 78*a* of the V-shaped lever 78 from the bent end 76*a* of the plate 76, and the plate 76 assumes its rightmost position keeping the latching device 18 in engagement with a striker (not shown) secured to the vehicle body, and the child proof lever 40 assumes its inoperative position wherein the child proof function is not achieved. In fact, when the locking knob 26 is pushed down, that is, in the direction of the arrow A in FIG. 3, the lever 32 is pivoted about the pin 34 in the counterclockwise direction, thereby lifting up the V-shaped lever 78 to cause disengagement of the lever 78 from the plate 76. During this lifting of the lever 78, the pin 82 of the lever 78 slides upward in and along the elongated slot 64 of the E-shaped outside lever third arm section 58*c* and the elongate slot section 84*c* of the base plate angularly U-shaped guide slot 84.

Under this condition, handling the inside handle 22 and/or the outside handle 24 does not bring about disengagement of the latching device 18. In fact, when, under this condition, the inside lever 52 and/or the outside lever 58 is moved in response to the handling of such handle 22 or 24, the V-shaped lever 78 pivots about the pin 80 in the clockwise direction with the pin 82 sliding in and along the second curved slot section 84*b* of the base plate 30. During this pivoting of the lever 78, the first arm section 78*a* of the lever 78 strikes at the air.

When, now, the locking knob 26 (see FIG. 1) is pulled up, that is, in a direction opposite to that of the arrow A, the lever 32 pivots about the pin 34 in the clockwise direction thereby moving down the V-shaped lever 78 to the position where the pin 82 of the lever 78 engages with the first curved slot section 84*a* of the base plate 30. In this condition, the first arm section 78*a* of the lever 78 engages with the bent end 76*a* of the rectangular plate 76, as is shown by FIG. 2. Thus, the counterclockwise rotation of the outside lever 58 about the pivot pin 60 caused by handling of the inside handle 22 and/or the outside handle 24 induces leftward movement of the rectangular plate 76. Thus, the latching device 18 is brought into disengaged condition.

Figure 4:
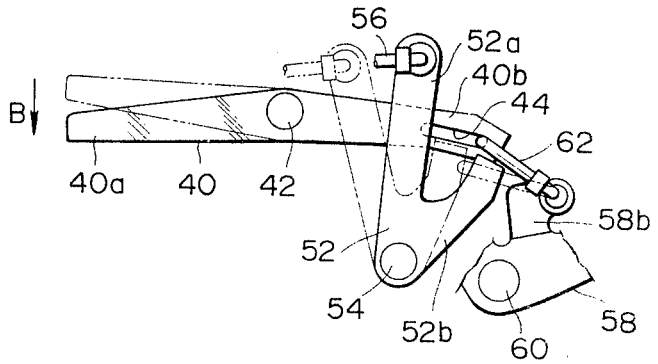

When the child proof lever 40 is now pushed down, that is, in the direction of the arrow B as is shown in FIG. 4, the right arm section 40*b* of the lever 40 is lifted up pivoting the U-shaped link 62 clockwisely about the leading end of the outside lever second arm section 58*b* to a position where the U-shaped link 62 is disengaged from the second arm section 52*b* of the inside lever 52. Thus, under this condition, the counterclockwise rotation of the inside lever 52 about the pivot pin 54 caused by handling of the inside handle 22 does not induce the pivoting movement of the outside lever 58. Thus, the engaged condition of the latching device 18 is not cancelled even when the first arm section 78*a* of the lever 78 assumes the position to engage with the rectangular plate 76.

Figure 5:
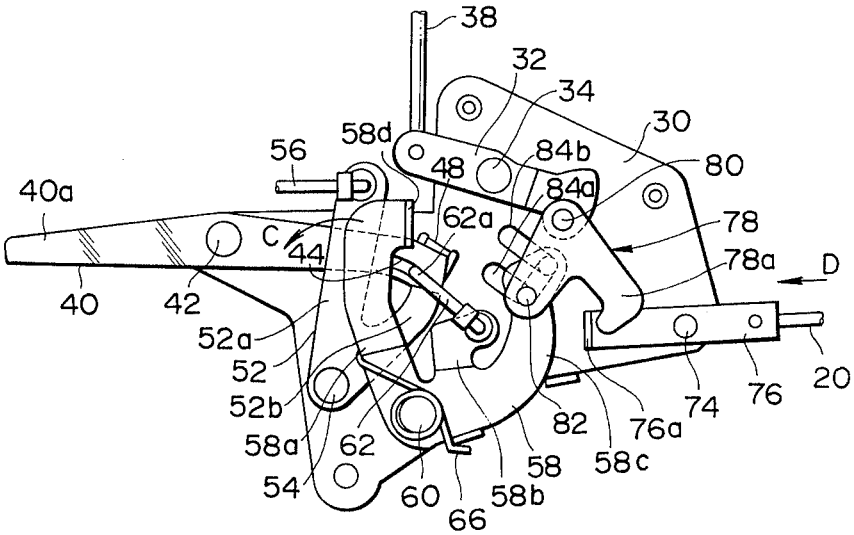

FIG. 5 shows a condition wherein the locking knob 26 is pulled up to cause the first arm section 78*a* of the V-shaped lever 78 to engage with the bent end 76*a* of the plate 76, and the child proof lever 40 is pushed down to cause disengagement of the U-shaped link 62 from the second arm section 52*b* of the inside lever 52. When, under this condition, the outside handle 24 is handled for the purpose of disengaging the latching device 18 mounted in the door 10, the generally E-shaped outside lever 58 is pivoted about the pivot pin 60 in the counterclockwise direction, that is, in the direction of the arrow C, the V-shaped lever 78 is forced to pivot about the pin 80 in the clockwise direction with the pin 82 thereof sliding in and along the first curved slot section 84*a* of the guide slot 84. With this clockwise rotation of the lever 78, the first arm section 78*a* of it moves the rectangular plate 76 in the direction of the arrow D. Thus, the latching device 18 is brought into its disengaged condition. Now, it is to be noted that during the counterclockwise movement of the outside lever 58, the leg portion 62*a* of the U-shaped link 62 slides leftward in and along the elongated slot 44 of the child proof lever 40.

As is understood from the foregoing description, in the child proof door locking device 12 according to the present invention, the child proof function is achieved by cancelling the mechanical connection between the inside handle-actuated inside lever 52 and the latching device-actuating outside lever 58. Thus, handling the inside handle 22 under the child proof condition of the door locking device 12 induces only inoperative or meaningless rotation of the inside lever 52. Thus, the undesirable breakage of the mutually engageable portions of the inside and outside levers 52 and 58 and those of the engageable portions of the inside lever and the child proof lever, which would occur sometimes in the afore-mentioned conventional child proof door locking device, does not occur in the present invention.

What is claimed is:

1. A child proof door locking device for use with an automative door having an inside handle, an outside handle, and a locking knob which are cooperated with one another to operate a latching device mounted to the automotive door, said child proof door locking device comprising:

a base plate structurally adapted to be securely attached to an automotive door;

an inside lever pivotally connected to said base plate and pivotally movable in response to manipulation of an inside handle of an automotive door;

an outside lever pivotally connected to said base plate and pivotally movable in response to manipulation of an outside handle of an automotive door;

first means for causing a latching device of an automotive door to assume its inoperative direction;

second means for linking said outside lever with said inside lever so that pivoting of said inside lever in a given direction induces the pivoting of said outside lever in said given direction;

third means actuated by a locking knob of an automotive door for causing said first means to be inoperative in operating the latching device irrespective of any angular positions assumed by said outside lever; and a child proof lever pivotally connected to said base plate and disabling said second means when assuming its child proof position.

2. A child proof door locking device as claimed in claim 1, in which said first means comprises:

a lever having first and second arm sections, said first arm section being engageable with a member which is synchronously movable with said latching device;

a pin secured to said second arm section to be movable therewith; and an elongated slot formed in said outside lever for slidably receiving therein said pin.

3. A child proof door locking device as claimed in claim 1 or 2, in which said second means comprises:

a link having one end pivotally connected to said outside lever; and an elongated slot formed in an end portion of said child proof lever for slidably receiving therein the other end of said link, wherein said link and said elongated slot are so arranged and constructed that said link is engageable with said inside lever when said child proof lever assumes a position other than said child proof position.

4. A child proof door locking device as claimed in claim 3, in which said third means comprises:

a lever pivotally connected to said base plate, one end of said lever being linked to said locking knob and the other end of the same being provided with a pivot pin about which said lever of said first means is pivotally supported; and an angularly U-shaped slot formed in said base plate to slidably receive therein said pin of said first means, said slot consisting of first and second curved slot sections and a straight slot section of which both ends are merged with said first and second curved slot sections, said first curved slot section being formed to be concentric with said pivot pin when said lever of said third means assumes a given angular position, and said second curved slot section being formed to be concentric with said pivot pin when said lever of said third means assumes another given position.

5. A child proof door locking device as claimed in claim 4, ln which said inside lever comprises first and second are sections and is pivotally connected, at the united portion thereof, through a pivot pin to said base plate, and- in which said link of said second means is formed into an angularly U-shaped link, the leading end of said second arm section of said inside lever being enclosed by the angularly U-shaped link and contactable with the same when said child proof lever assumes the position other than said child proof position, but, the leading end of said second arm section of said inside lever being separated and disengaged from said angularly U-shaped link when said child proof lever assumes said child proof position.

6. A child proof door locking device as claimed in claim 5, in which said outside lever comprises first, second and third arm sections and is pivotally connected, at the united portion thereof, through a pivot pin to said base plate, said first arm section being engageable with said outside handle, said second arm section having a leading end to which the one end of the angularly U-shaped link is pivotally connected, and said third arm section having the elongated slot formed therein.

7. A child proof door locking device as claimed in claim 6, in which said outside lever is biased to rotate a direction opposite to said given direction.

8. A child proof door locking device for use with an automotive sliding door having an inside handle, an outside handle, and a locking knob which are cooperated with one another to operate a latching device which is mounted to one side of the door with respect to the direction in which the door slides, said child proof door locking device comprising:

a base plate structurally adapted to be securely attached to the other side of the door;

an inside lever pivotally connected to said base plate and pivotally movable in response to manipulation of an inside handle of the door;

an outside lever pivotally connected to said base plate and pivotally movable in response to manipulation of an outside handle of the door;

first means for causing a latching device of the door to assume its inoperative condition when said outside lever is pivoted in a given direction;

second means for linking said outside lever with said inside lever so that pivoting of said inside lever in a given direction induces the pivoting of said outside lever in said given direction;

third means actuated by the locking knob for causing said first means to be inoperative in operating the latching device irrespective of any angular positions assumed by said outside lever; and a child proof lever pivotally connected to said base plate and disabling said second means when assuming its child proof position.

* * * * *